US007959416B2

(12) United States Patent
Bosco, Jr. et al.

(10) Patent No.: US 7,959,416 B2
(45) Date of Patent: Jun. 14, 2011

(54) SUCTION SYSTEM FOR A REFRIGERATION COMPRESSOR

(75) Inventors: Raul Bosco, Jr., Joinville-Sc (BR); Fabian Fagotti, Joinville-SC (BR); Marcos Giovani Dropa de Bortoli, Joinville-Sc (BR)

(73) Assignee: Whirlpool S.A., Sao Paulo-Sp (BR)

( * ) Notice: Subject to any disclaimer, the term of this patent is extended or adjusted under 35 U.S.C. 154(b) by 944 days.

(21) Appl. No.: 10/597,469

(22) PCT Filed: Feb. 1, 2005

(86) PCT No.: PCT/BR2005/000014

§ 371 (c)(1),
(2), (4) Date: Sep. 12, 2006

(87) PCT Pub. No.: WO2005/075828

PCT Pub. Date: Aug. 18, 2005

(65) Prior Publication Data

US 2008/0159881 A1 Jul. 3, 2008

(30) Foreign Application Priority Data

Feb. 4, 2004 (BR) ..... 0400624

(51) Int. Cl.
*F02M 35/00* (2006.01)

(52) U.S. Cl. ..... 417/312; 417/571; 181/229; 181/403

(58) Field of Classification Search ..... 417/312, 417/569, 571; 181/229, 403
See application file for complete search history.

(56) References Cited

U.S. PATENT DOCUMENTS

| | | | | | |
|---|---|---|---|---|---|
| 4,582,468 | A | * | 4/1986 | Bar | 417/312 |
| 5,542,824 | A | * | 8/1996 | Lee | 417/312 |
| 5,577,898 | A | * | 11/1996 | Lee | 417/312 |
| 5,584,674 | A | | 12/1996 | Mo et al. | |
| 5,722,818 | A | | 3/1998 | Ohta et al. | |
| 5,733,106 | A | | 3/1998 | Lee et al. | |
| 5,950,307 | A | | 9/1999 | Lee et al. | |
| 5,988,990 | A | * | 11/1999 | Lee | 417/312 |
| 6,149,402 | A | * | 11/2000 | Kim | 417/312 |
| 7,244,108 | B2 | * | 7/2007 | Kubota et al. | 417/312 |
| 2002/0098093 | A1 | | 7/2002 | Tomell et al. | |

FOREIGN PATENT DOCUMENTS

| | | |
|---|---|---|
| JP | 63005187 | 1/1988 |
| JP | 01003275 | 1/1989 |
| JP | 01003276 | 1/1989 |
| JP | 64000371 | 1/1989 |
| JP | 01060784 | 3/1989 |
| JP | 01080781 | 3/1989 |
| JP | 05099141 | 4/1993 |
| JP | 07208334 | 8/1995 |

* cited by examiner

*Primary Examiner* — Devon C Kramer
*Assistant Examiner* — Patrick Hamo
(74) *Attorney, Agent, or Firm* — Gifford, Krass, Sprinkle, Anderson & Citkowski, P.C.

(57) ABSTRACT

A suction system for a refrigerator compressor includes a suction muffler with an outlet tube mounted to a valve plate and a cylinder head having a reinforced portion in the area of the valve plate and the outlet tube.

8 Claims, 2 Drawing Sheets

SUCTION SYSTEM FOR A REFRIGERATION COMPRESSOR

CROSS-REFERENCE TO PRIOR APPLICATION

This is a U.S. National Phase Application under 35 U.S.C. §371 of International Patent Application No. PCT/BR2005/000014 filed Feb. 1, 2005, which claims priority of Brazilian Patent Application No. PI 0400624-0 filed Feb. 4, 2004, both of which are hereby incorporated by reference. The International Application published in English on Aug. 18, 2005 as WO 2005/075828 A1 under PCT Article 21(2).

FIELD OF THE INVENTION

The present invention refers to a suction system for a refrigeration compressor, particularly for suction systems of the type which presents a suction muffler.

BACKGROUND OF THE INVENTION

Refrigeration compressors generally comprise, in the interior of a shell, a motor-compressor assembly having a cylinder block within which is defined a cylinder having an end closed by a cylinder head defining therewithin a housing for adaptation of a suction muffler, and a discharge chamber in selective fluid communication with a compression chamber defined inside the cylinder and which is closed by a valve plate provided between the closed end of the cylinder and the cylinder head, said fluid communication being defined through suction and discharge orifices provided in said valve plate and which are selectively and respectively closed by suction and discharge valves generally carried by the valve plate.

Contiguously to such orifices there are mounted noise mufflers upstream the suction orifice and downstream the discharge orifice. In order to maintain a good thermal insulation between the relatively cold gas that is drawn and the other components adjacent to the suction muffler, the latter is generally constructed in plastic material. Thus, the overheating of the gas which is drawn along the path from the compressor inlet to the suction orifice is minimized, resulting in better volumetric yield, thereby optimizing the performance in terms of efficiency and pumping capacity (mass flow).

The cylinder head usually defines a first element of the compressor discharge muffler and it is usually constructed in metallic material so as to resist the pressure differences to which it is submitted, since its internal face is exposed to the discharge pressure and its external face to the suction pressure.

Since the suction and discharge orifices for the admission and discharge of gas in relation to the cylinder are normally close to each other, having their spatial distribution usually limited to be contained in the valve plate in the region in which it covers the cylinder, the elements that cover them (suction chamber and cylinder head) present a contiguous section. The negative effect of such proximity is that the cylinder head is the warmest point of the compressor and the heat generated thereby is thus easily transmitted to the suction chamber and therefrom to the gas to be drawn by the cylinder. This results in higher overheating of said gas and reduction of yield and capacity, as explained above.

A known project solution which is normally adopted to define the channels leading to both the suction orifice and the discharge orifice is to make the suction chamber discharge the gas flow in a volume defined by a cavity in the cylinder head and valve plate, as illustrated in FIG. 2. This construction presents the advantage of being relatively simple to manufacture, requiring components of little geometrical complexity and resulting in a structurally rigid cylinder head, which is very interesting when the working fluid causes great pressure differences and/or the size of this cylinder head is relatively large. On the other hand, there is a metallic interface separating the suction valve antechamber containing a relatively cold gas (desired to be maintained) from the cylinder discharge chamber containing hot gas. Thus, there is an intense heat transfer between both chambers, negatively influencing the performance. Furthermore, the mounting process of the suction muffler in the cylinder head requires the inclusion of relatively complex fixation elements, such as threads, or the inclusion of intermediary elements, such as a metallic suction tube, since the material (plastic) of the suction muffler tends to deform with time when submitted to temperatures which in certain cases occur in this region of the compressor, not guaranteeing the necessary reliability in the fixation of the suction muffler to the cylinder head. Moreover, to guarantee a perfect sealing between the elements, additional elements, such as o'rings or gaskets, are usually included to prevent eventual leakages from impairing the attenuation of noise, which is the main function of the suction muffler.

FIGS. 3-4 illustrate another prior art construction for the suction system which avoids the problems mentioned above. In this construction, the suction tube is constructed in plastic material and seated on the valve plate externally to the cylinder head, i.e., the suction tube is not disposed through the interior of the cylinder head, which maintains it spaced from the warmest region of the discharge chamber. In this construction, the temperatures to which the suction tube is submitted are considerably lower than those in the construction described above, thus avoiding the use of intermediary fixation elements of said prior art construction. Furthermore, the need for additional sealing elements is eliminated, since said sealing occurs in the interface between the suction tube and the gasket seated against the valve plate.

However, the disadvantage of this solution resides in the reduction of the structural rigidity of the cylinder head. In compressors that work with fluids which cause great pressure differences between the suction and discharge sides, or in compressors that have larger dimensions, deformations may occur in the cylinder head and cause leakages, impairing the performance, or ruptures in the gasket, making the compressor lose its functional characteristics. Moreover, this prior art solution further allows the occurrence of deformations as a function of the load imposed by the fixation elements (generally screws) of the cylinder head to the cylinder block, A way to overcome the deficiency of structural fragility of this known prior art solution would be the use of materials with a higher modulus of elasticity, but which has the disadvantage of increasing the cost of the component, whether by using a nobler material, or materials that need more complex manufacturing processes.

OBJECTS OF THE INVENTION

Thus, it is an object of the present invention to provide a suction system for a refrigeration compressor which does not impair the cylinder performance, minimizing heat transfer, in the region of the cylinder head, to the gas directed to the suction chamber, and which imparts higher structural rigidity to the cylinder head.

It is another object of the present invention to provide a system such as mentioned above, of simple construction and reduced cost and which does not impair the noise attenuation by the suction muffler.

SUMMARY OF THE INVENTION

These and other objects are attained by a suction system for a compressor of the type which comprises: a cylinder; a valve plate which is provided with at least one suction orifice, selectively closed by a suction valve, and which closes a cylinder end; a cylinder head mounted against a face of the valve plate opposite to that closing the cylinder and which defines a discharge chamber occupying part of said cylinder head and partially contouring the suction orifice; and a suction muffler comprising a hollow body having an outlet tube projecting therefrom and presenting a free end seated on the valve plate in coaxial alignment with a respective suction orifice, said cylinder head being provided, externally to the discharge chamber, with a reinforcing wall portion which is dimensioned to define an increase in the structural rigidity of the cylinder head.

BRIEF DESCRIPTION OF THE DRAWINGS

The invention will be described with reference to the enclosed drawings, in which.

DESCRIPTION OF THE ILLUSTRATED EMBODIMENT

Figure 1:
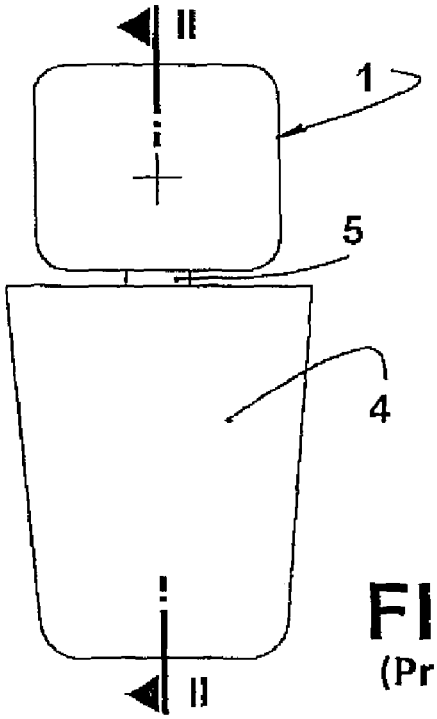
FIG. 1 (Prior Art)
FIG. 1 illustrates, schematically, a rear view of the suction muffler mounted in the cylinder head, according to a prior art construction.

The present invention will be described in relation to a compressor of a refrigeration system which, though not illustrated, comprises inside a shell, such as a hermetic shell, a motor-compressor assembly having a cylinder block within which is defined a cylinder which lodges, at one end, a piston, and has an opposite end closed by a cylinder head 1 defining a discharge chamber 2 therewithin in selective fluid communication with a compression chamber (not illustrated) defined in the inside of the cylinder between a top portion of the piston and a valve plate 3 provided between the opposite end of the cylinder and the cylinder head 1.

The valve plate 3 is provided with at least one suction orifice 3*a* and with a discharge orifice (not illustrated) which are selectively and respectively closed by suction and discharge valves (not illustrated), each suction orifice 3*a* allowing the selective fluid communication between the discharge chamber 2 and the compression chamber of the cylinder. The suction system being described further comprises a suction muffler 4, generally made in a material of low thermal conductibility, having a hollow body provided with a gas inlet (not illustrated) in fluid communication with the gas supplied to the compressor, and carrying an outlet tube 5 in fluid communication with a suction side of the compressor, said outlet tube 5 presenting an end 6 internal to the hollow body and a free end 7 outwardly projecting from the hollow body and seated on the valve plate 3 in coaxial alignment with a respective suction orifice 3*a*.

Figure 2:
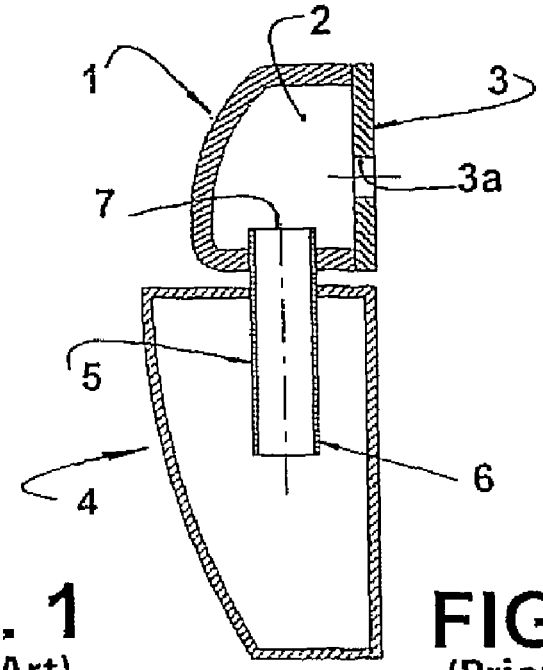
FIG. 2 (Prior Art)
FIG. 2 illustrates, schematically, a longitudinal sectional view of the suction muffler-cylinder head assembly, according to line II-II shown in FIG. 1.

According to a constructive form of the prior art suction system illustrated in FIGS. 1 and 2, the outlet tube 5 is mounted to the cylinder head 1 so as to have its free end 7 mounted through the cylinder head 1. Although in said solution the cylinder head 1 presents a strong construction, this solution presents the disadvantages discussed above.

Figure 3:
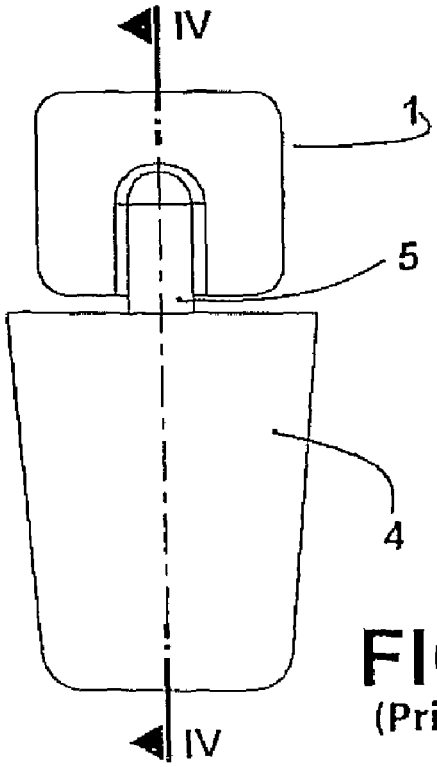
FIG. 3 (Prior Art)
FIG. 3 illustrates, schematically, a rear view of the suction muffler mounted in the cylinder head, according to another prior art construction.
Figure 4:
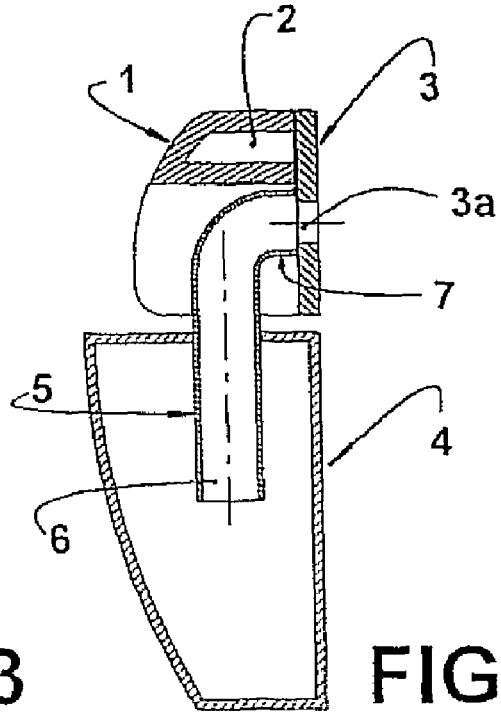
FIG. 4 (Prior Art)
FIG. 4 illustrates, schematically, a longitudinal sectional view of the suction muffler-cylinder head assembly, according to the line IV-IV shown in FIG. 3.
Figure 5:
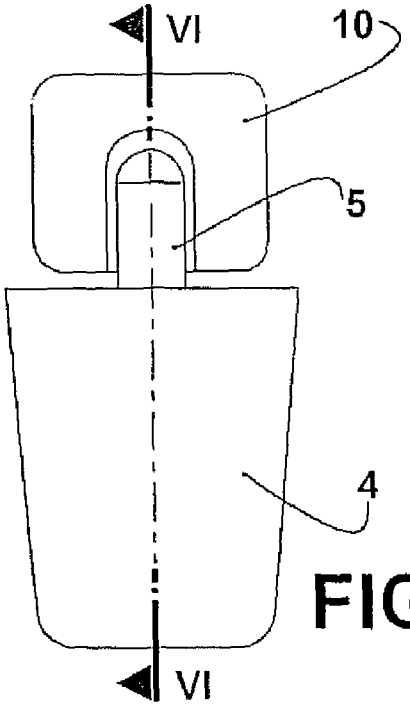
FIG. 5 illustrates, schematically, a rear view of the suction muffler mounted in the cylinder head, according to the present invention.
Figure 6:
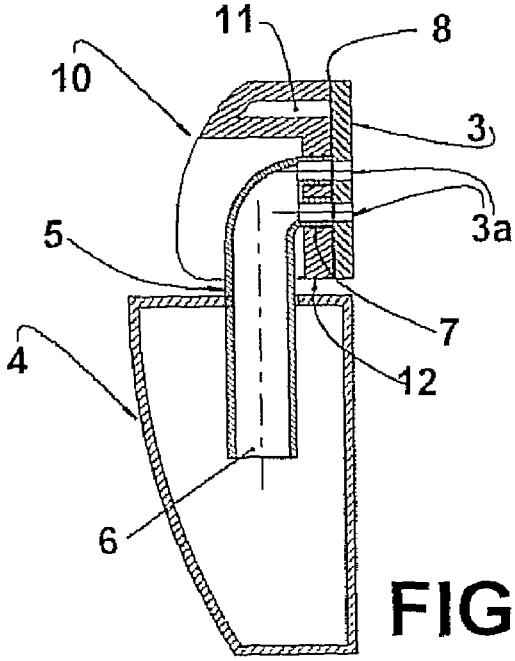
FIG. 6 illustrates, schematically, a longitudinal sectional view of the suction muffler-cylinder head assembly, according to the line VI-VI shown in FIG. 5.
Figure 7:
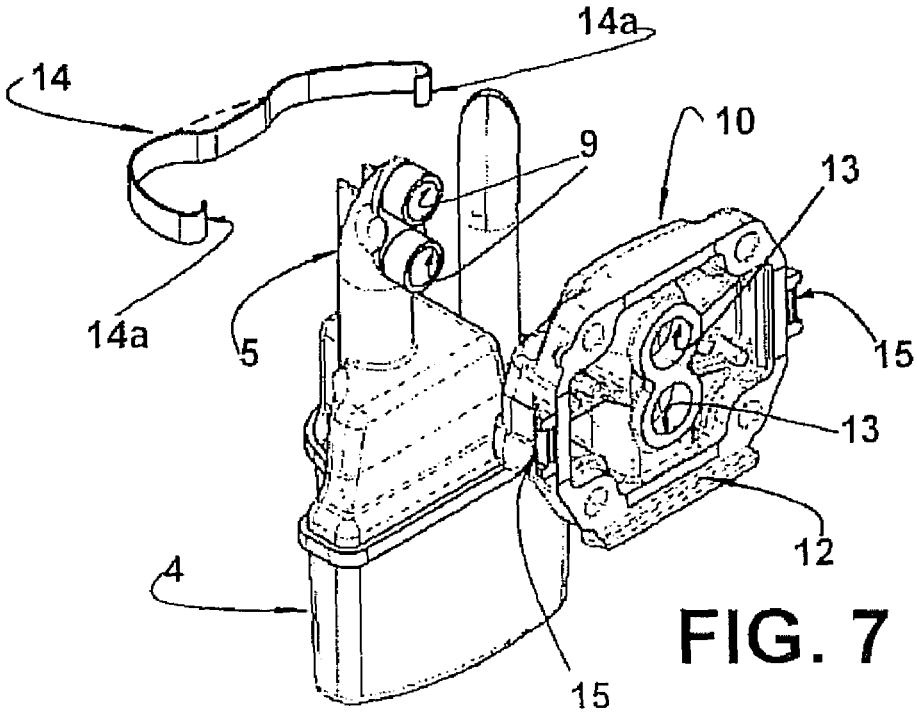
FIG. 7 illustrates, schematically and in exploded front perspective view, the suction muffler and cylinder head, constructed according to the present invention.

According to another constructive form illustrated in FIGS. 3 and 4, the outlet tube 5 has its free end 7 seated on the valve plate 3 external to the cylinder head 1. In this construction, the cylinder head 1 is shaped in such a way that the outlet tube 5 need not penetrate into the internal volume of said cylinder head 1, minimizing the heating of the gas being drawn. However, said solution presents a cylinder head 1 with a less strong construction and with the previously mentioned disadvantages.

The system of the present invention comprises a cylinder head 10 provided, externally to its discharge chamber 11, with a reinforcing wall portion 12 which is dimensioned to define an increase in the structural rigidity of said cylinder head 10, said reinforcing wall portion 12 having at least part of its extension spaced from the outlet tube 5 in order to minimize the heat transfer from the cylinder head 10 to the gas being drawn through the outlet tube 5. In a constructive option of the present invention, the reinforcing wall portion 12 occupies the area of the cylinder head 10 external to the discharge chamber 11. The construction of the cylinder head of the present invention aims at maintaining the advantages presented by the prior art constructions illustrated in FIGS. 1-4, without the deficiencies thereof. The cylinder head 10 of the present invention is constructed so as not to have a section presenting a through passage, such as that of the prior art illustrated in FIG. 3, i.e., maintaining a structural rigidity which is greater than that presented by said prior art construction and similar to that of the construction illustrated in FIG. 1. Since the sealing of the junction of the discharge chamber 11 to the valve plate 5 occurs on a gasket 8, the construction of the present invention does not require the inclusion of additional sealing and fixation elements found in the prior art construction illustrated in FIG. 1.

In a constructive option of the present invention, the reinforcing wall portion 12 maintains the outlet tube 5 seated on the valve plate 3, said reinforcing wall portion 12 being for example also seated on the valve plate 3. In a variant of this solution, the reinforcing wall portion 12 is medianly opened so as to involve and retain the free end 7 of the outlet tube 5, which trespasses said opened portion, to be seated on the valve plate 3, or also to allow the free end 7 of the outlet tube 5 to be fitted into at least part of the extension of a respective suction orifice 3*a* in the valve plate 3.

In the illustrated solution, the free end 7 of the outlet tube 5 is provided with two tubular projections 9, which are parallel and for example axially spaced from each other and each aligned with a respective suction orifice 3*a* of the valve plate 3.

In this construction, the cylinder head 10 is provided in the region of the reinforcing wall portion 12 with a pair of openings 13 which are parallel to each other, so that each receives a tubular projection 9 of the outlet tube 5, said openings 13 having their contour seated against the valve plate 3.

The tubular projections 9 provide the necessary thermal insulation between the cold gas and the adjacent warmest section represented by the cylinder head 1, besides representing an additional acoustic dampening in case any leakage occurs between the suction muffler and the gasket 8, which makes this construction acoustically stronger than that of the prior art illustrated in FIG. 3. These tubular projections 9 can, for example, project farther than as shown herein and have an additional extension to cover part or the whole thickness of the valve plate 3, providing an additional thermal insulation to another warm part of the compressor. With this construction, the temperature to which the interior of the suction muffler is submitted becomes similar to that presented by the solution of FIG. 3, allowing the use of plastic material to construct its body, which simplifies the manufacturing and mounting process in relation to the prior art solution illustrated in FIG. 1.

In another constructive option, not illustrated, the reinforcing wall portion 12 is trespassed by the outlet tube 5 in a portion thereof spaced from the valve plate 3.

According to the present invention, there is further provided a fixation element 14, for example in the form of a spring which surrounds the outlet tube 5 mounted in the cylinder head 10, said fixation element having a pair of retaining end portions 14*a*, each fitted into a fitting receiving portion 15 defined in the cylinder head 10, for example in lateral portions thereof, said fitting receiving portions 15 being aligned to each other and orthogonal to the alignment of the openings 13 of said cylinder head 10.

The fixation element 14, in this construction, has its movements restricted by the tubular projections 9 in axes that are orthogonal to each other and parallel to the valve plate 3, said spring restricting the movement of the suction muffler in the directions parallel to the valve plate 3, i.e., only in the directions in which the spring has some actuation.

The fixation element 14 exerts on the suction muffler 4 a friction force in a direction parallel to the outlet tube and to the valve plate 3 and, in the other directions, the force occurs by the rigidity of the fixation element 14. Additionally, eventual deformations caused to the cylinder head 10 by action of the fixation element 14 occur so as to better seal the region of the gasket 8 that is more susceptible to leakages and rupture, in this case the portion between the tubular projections 9.

While a construction for fixation means has been illustrated, it should be understood that other constructions are possible, such as a spring element, which can be affixed to the regions of the cylinder head adjacent to the outlet tube 5 through fixation means, such as adhesive, screws, etc., which aspect should not be considered as a limitation for the inventive concept presented herein.

The invention claimed is:

1. A suction system for a refrigeration compressor of the type which comprises a cylinder;

a valve plate which is provided with at least two suction orifices, each selectively closed by a suction valve, and which closes a cylinder end;

a cylinder head mounted against a face of the valve plate opposite to that closing the cylinder and which defines a discharge chamber occupying part of said cylinder head and partially contouring the suction orifices; and a suction muffler comprising a hollow body having an outlet tube projecting from within said suction muffler and outwardly to present a free end seated on the valve plate, said cylinder head being provided, externally to the discharge chamber, with a reinforcing wall portion, wherein the free end of the outlet tube is provided with two tubular projections which are parallel to each other, each being coaxially aligned with and seated against a respective one of the suction orifices of the valve plate and in that the reinforcing wall portion has an extension, which is spaced from the outlet tube and has two openings which are parallel to each other, so that each receives a tubular projection of the outlet tube, said openings having their contour seated against the valve plate.

2. The system as set forth in claim 1, wherein the reinforcing wall portion maintains the outlet tube seated on the valve plate.

3. The system as set forth in claim 2, wherein the reinforcing wall portion engages and supports the outlet tube.

4. The system as set forth in claim 2, wherein the reinforcing wall portion is seated against the valve plate.

5. The system as set forth in claim 4, wherein the reinforcing wall portion occupies the area of the cylinder head external to the discharge chamber.

6. The system as set forth in claim 5, wherein the reinforcing wall portion is medianly opened so as to surround and retain the free end of the outlet tube.

7. The system as set forth in claim 1, wherein the free end of the outlet tube is fitted into an interior of at least part of an extension of a respective suction orifice in the valve plate.

8. The system as set forth in claim 1, comprising a fixation element constantly forcing the cylinder head against the valve plate.

* * * * *